United States Patent [19]

Sueyoshi et al.

[11] Patent Number: 4,904,196

[45] Date of Patent: Feb. 27, 1990

[54] RELEASABLE CONNECTOR FOR ELECTRIC CIRCUITS

[75] Inventors: Tadahiro Sueyoshi; Tetsuo Kato; Akira Maeda, all of Shizuoka, Japan

[73] Assignee: Yazaki Corporation, Tokyo, Japan

[21] Appl. No.: 218,916

[22] Filed: Jul. 14, 1988

[30] Foreign Application Priority Data

Jul. 17, 1987 [JP] Japan ..... 62-109075[U]

[51] Int. Cl.[4] ..... H01R 13/703

[52] U.S. Cl. ..... 439/188; 439/378; 200/51.1

[58] Field of Search ..... 439/188, 852, 378, 95, 439/96; 200/51.1; 102/202.1, 202.2, 202.9

[56] References Cited

U.S. PATENT DOCUMENTS

| | | | |
|---|---|---|---|
| 1,959,479 | 5/1934 | Kielczewski et al. | 102/206 |
| 2,880,671 | 4/1959 | Lutz et al. | 361/248 |
| 3,040,284 | 6/1962 | Connell | 439/320 |
| 3,045,079 | 7/1962 | Frantz | 439/188 |
| 3,180,263 | 4/1965 | Williams | 102/202.4 |
| 3,344,744 | 10/1967 | Bankston, Jr. | 102/202.1 |
| 3,370,140 | 2/1968 | Betts | 200/51.1 |
| 3,483,312 | 12/1969 | McDonald et al. | 174/87 |
| 3,512,043 | 5/1970 | Jaaksoo | 361/35 |
| 3,585,933 | 6/1971 | Kos | 102/202.1 |
| 3,682,096 | 8/1972 | Ludke et al. | 102/202.9 |
| 3,838,206 | 9/1974 | Eklund | 174/87 |
| 4,139,255 | 2/1979 | Otani | 439/851 |
| 4,170,939 | 10/1979 | Hoheisel et al. | 439/511 X |
| 4,253,719 | 3/1981 | McGinley | 439/629 X |
| 4,271,453 | 6/1981 | Yajima et al. | 361/248 |
| 4,369,707 | 1/1983 | Budde | 102/202.2 |
| 4,786,258 | 11/1988 | Shaffer et al. | 439/188 |

FOREIGN PATENT DOCUMENTS

| | | | |
|---|---|---|---|
| 2903896 | 8/1979 | Fed. Rep. of Germany | 439/188 |
| 2030483 | 11/1970 | France . | |
| 52-12814 | 4/1977 | Japan . | |
| 906181 | 9/1962 | United Kingdom . | |

OTHER PUBLICATIONS

IBM Bulletin, Perkins, vol. 7, No. 6, p. 424, 11/1964; "Switching Connector".

*Primary Examiner*—Neil Abrams
*Assistant Examiner*—Khiem Nguyen
*Attorney, Agent, or Firm*—Robbins & Laramie

[57] ABSTRACT

A releasable connector for electric circuits is composed of a male connector housing and a female connector housing adapted to be fittable in each other. One of the connector housings is provided with a resilient short-circuit member while the other is provided with an insulator member. When the two parts are released from each other, the short-circuit member is resiliently urged against the upper surfaces of the terminals in the one connector housing so as to make a short circuit between the terminals. When the two housings are coupled together, the insulator member in the other connector housing wedges in between the short-circuit member and the terminals in the one connector housing so as to break the short circuit made therebetween. With this construction, it is ensured that any current being induced by and under the influence of external magnetic fields or electric fields or static electricity within the system to which the invention is applied is prevented from flowing through the associated circuit elements thus avoiding malfunctions of the elements.

6 Claims, 2 Drawing Sheets

RELEASABLE CONNECTOR FOR ELECTRIC CIRCUITS

BACKGROUND OF THE INVENTION

1. Field of the Invention

The invention generally relates to a releasable connector for electric circuits and more specifically to an improved releasable connector of the character in which it is assured, when the connector terminals are released from each other, that the associated circuit elements are protected against the risk of malfunctions thereof due to induced currents occurring under the influence of external electromagnetic waves or static electricity being present in the proximity of the circuit.

2. Description of the Prior Art

In a motor traffic field, there has been well known the use of air bags serving as a safety system for protection of the car occupants from any fatal impacts possibly caused by collisions of two or more cars. In this system, an ignition element associated with the air bag is mounted in a loading chamber charged with a gas producing agent. Signal lines are connected to this ignition element, which in turn are connected, via a releasable connector, to a battery acting as a power source and a collision sensor element in the form of a switch, respectively, thus forming an air bag circuit. The connector interposed between the signal lines connects the "source side" and the "element or load side" of the system circuit.

It is arranged that upon a collision of cars, the sensor element is activated to send electric signals to the ignition element which responsively sets fire to the gas producing agent so that the air bag is inflated by a great quantity of gas being produced. In consequence, the car occupants can be protected from what would otherwise be fatal impacts occurring at the moment of collision. While this air bag of course is required to act at the very moment of collision, it should be avoided imperatively for the air bag to act at any moment other than in such emergency.

However, the conventional safety system employing air bags just described is in practice encountered with the problem that follows.

For the purpose of mounting, placing or inspecting the air bag installed in the car, it is a necessary step for the technician or serviceman to once release the connector intentionally. In this instance, the respective paired terminals are released from each other to disconnect the signal line on the "element or load side" from that on the "source side". Problems may arise, on such occasion, if, adjacent to the signal line on the "element or load side", there happens to be mounted some electric wire through which currents start to flow or varying currents flow, or some conductible body having static electricity accumulated thereon, still or the terminals on the "element or load side" happen to be subjected to external electromagnetic waves. In these situations, the result is that the signal lines are supplied with momentary voltages being induced by such variation of the magnetic fields or electric fields. The level of voltage occurring between the signal lines depends on the extent of effects of the magnetic fields or electric fields to which the signal lines are subjected. Thus, there is produced a momentary flow of current through the load acting elements in the system. Since the air bag is sensitive in function to such flow of current no matter how minor it is, there may be every good reason for possible occurrence of malfunctions of the circuit elements in the system.

When a conventional connector is disconnected, the respective paired terminals are released from each other, rendering the terminal ends open. The conventional connector may suffer drawbacks involving all of the above described currents, which, if induced, will flow through the circuit elements thus making it impossible to prevent the risk of malfunctions of the circuit elements used in the system.

SUMMARY OF THE INVENTION

The invention, therefore, aims to eliminate such drawbacks in the prior art described above by providing a releasable connector for electric circuits of the character which ensures not to let electric currents, induced by and under the influence of external magnetic fields or electric fields, flow through the circuit elements in the system to which the inventive connector is applied.

To achieve the above described objects, therefore, the invention is directed to a releasable connector for electric circuits comprising a male connector housing and a female connector housing adapted to fit in each other in face-to-face relation, wherein one of the connector housings is provided interiorly and adjacent to a guide aperture opened at the interface thereof, with a terminal receiving cavity and a short-circuit member receiving cavity with a communication space formed therebetween A resilient short-circuit member of electric conductibility is disposed within the short-circuit member receiving cavity in such manner that the short-circuit member extends through the communicating space so as to be brought into resilient contact with the respective terminal elements. The other connector housing is provided interiorly with an insulator member which is adapted, to be thrusted in between the short-circuit member and the terminal elements with which the short-circuit member has been in resilient contact when the two connector housings are coupled to one another.

These and other objects and features of the invention will become clear by referring to the following description in conjunction with the drawings.

DETAILED DESCRIPTION OF PREFERRED EMBODIMENTS

The invention will now be described in accordance with its preferred embodiments by referring to FIGS. 1 through 3.

Figure 1:
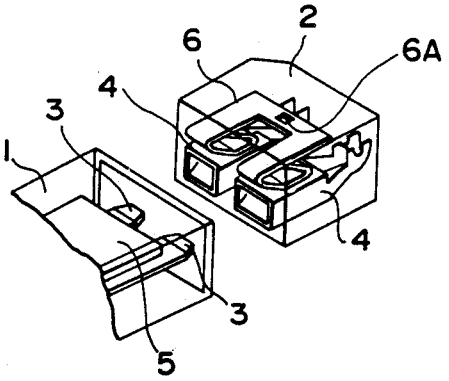
FIG. 1 is a perspective view schematically showing one embodiment of a releasable connector parts according to the invention.

In FIG. 1, there are shown a male connector housing 1 and a female connector housing 2 as disconnected from each other, which constitute a releasable connector assembly upon fitting of the two parts in each other. As shown in FIGS. 1 and 2, the male connector housing 1 contains therein a pair of plug-like terminals 3, 3 disposed in a terminal receiving cavity 1A while the female connector housing 2 contains therein a further pair of socket-like terminals 4, 4 disposed in a further terminal receiving cavity 2A. The female terminals 4, 4 have hitherto been fabricated from a conductive sheet metal into a planar configuration by punching and comprise rectangular or circular (not shown) in section member formed by bending, as shown in FIG. 1. This particular configuration of the female terminals is intended to avoid their deformation and hence deterioration of contact that might otherwise occur when fitting the male terminals in their cooperating female terminals.

The female connector housing 2 further contains therein a resilient short-circuit member of conductive material , which has been fabricated from a thin metal by punching and bending. This resilient member is disposed in a cavity 2B and secured in place by a retaining projection formed on the short-circuit member 6. The resilient short-circuit member is configured as a generally ellipsoidal element having two parallel legs with their end portions bent back in alignment with and in resilient pressing contact with their cooperating terminals 4, 4. A communicating space 2C is provided between the short-circuit member receiving cavity 2B and the terminal receiving cavity 2A. The short-circuit member 6 has its bent portions extended, through the communicating space, into the terminal receiving cavity 2A in such manner that the bent portions or the contact portions of the member 6 are resiliently urged against the upper surfaces of the female terminals 4, 4 by the springy action of the short-circuit member 6 itself. On the other hand, the male connector housing 1 defines therein an insulator plate receiving cavity in which an insulator plate 5 is secured in place and parallel to the male terminals 3, 3. It is adapted, when fitting the two parts in each other, that the insulator plate 5 slides through a guide aperture 2D opened at the interface of the connector housing 2, and thrusts in between the short-circuit member 6 and the female terminals 4, 4 which have thus far been in pressing contact with the short-circuit member 6. This causes the member 6 to be resiliently moved away from the terminals 4, 4. In this short-circuit breaking mechanism, it is to be noted that the guide aperture 2D is designed to have an opening size just enough to permit insertion of the insulator plate 5 therethrough.

It is advantageously constructed, therefore, that the short-circuit member receiving cavity defined in the interior of the connector housing is exposed outwardly only through the guide aperture 2D which is sized just enough to allow the insulator plate 5 to pass therethrough. This reduces or eliminates the risks of the short-circuit member 6 being inadvertently separated from the respective terminals even when any material or obstacle outside tends to enter the connector housing.

The male connector housing, meanwhile, has disposed therein an insulator plate 5 which is secured in place and parallel to the male terminals 3,3 but does not project out of the housing. This insulator plate 5 is adapted, when the two housings are connected together, to fit in the guide aperture 2D opened at the interface of the female connector housing, serving to separate the short-circuit member 6 from the female terminals 4, 4. Since the insulator plate 5 is thus kept recessed within the connector housing, it will hardly be affected adversely under the influence of external forces.

Figure 3:
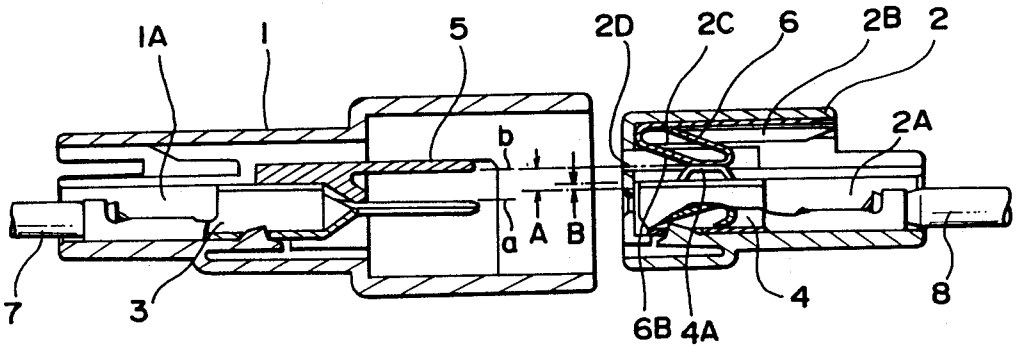
FIG. 3 is a similar view to FIG. 2 showing the connector housings as released from each other.

As shown in FIG. 3, the female terminals 4, 4 preferably provide respective projections 4A, 4A to be kept in contact with the resilient contact portions 6B,6B of the short-circuit member 6. With this projection 4A, the distance between the upper edges of the terminals 4,4 and the lower edges of the resilient contact portions 6B,6B is expressed by "A", whereas the same is expressed by "B" when the projections 4A are omitted. Here, A is greater than B. If the distance in question is selected smaller like B, there may arise the problems that when coupling the two housings, the insulator plate 5 happens to be caught on the edges of the socket openings of the female terminals 4,4, thus causing failure in proper coupling of the connector housings. Alternatively, when the insulator plate 5 is caught on the socket opening, the plate may possibly be broken, so that even if the coupling of the two housings 1 and 2 is completed, the short-circuit member 6 will not separate from the female terminals 4,4.

Referring again to the short-circuit member 6, it has been shown in the illustrated embodiment of the invention as making a short-circuit between the female terminals. According to the arrangement, the necessary extent of deformation for the resilient contact portions 6B,6B is indicated at "b" in FIG. 3, i.e. the same has only to be as small as "b". On the contrary, when the short-circuit member 6 is to short-circuit between the male terminals 3,3 instead, the resilient contact portions 6B,6B need to be deformed as far as "a". This tends to cause an insecure contact and, in order to secure the contact, the resilient contact portion of the short-circuit member 6 especially are necessarily increased in size or bulk. Hence, it is more advantageous in practice to short-circuit between the female terminals than between the male terminals since, in the former case, the extent of deformation for the resilient contact portions of the short-circuit member 6 can be reduced while their mechanical wear is avoided.

Further, 7 represents a signal line on the "source side" of the system circuit while 8 represents a further signal line on the "load side" to be connected to undepicted circuit elements.

Figure 2:
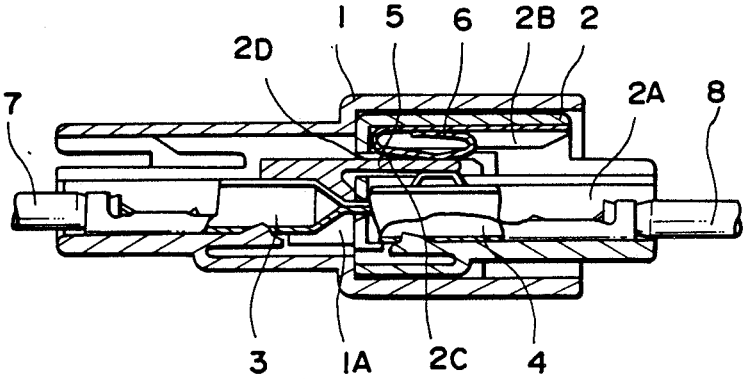
FIG. 2 is a cross-sectional view showing an arrangement of connector parts when the connector housings are fitted in each other.

FIG. 2 shows the connector with the two male and female housings coupled together, and FIG. 3 shows the same however as disconnected from each other.

When the two connector housings are not coupled with each other as shown in FIG. 3, the short-circuit member 6 is kept in pressing contact with the terminals 4, 4 on the "element or load side", which avoids the occurrence of potential differences between the terminals 4, 4. This enables the protection of the electronic circuit on the "element or load side" as well as the prevention of malfunctions of the elements.

When the two connector housings are fitted in each other, as shown in FIG. 2, the signal lines 7 and 8 on the "source side" and the "element or load side", respectively, are brought into communication with each other. Since, in this situation, the mutual conductive connection between the short-circuit member 6 and the female terminals 4, 4 is interrupted, the occurrence of troubles due to short-circuiting when there occur flows of electric currents through the circuit elements can be prevented.

In addition, the invention also is featured by the fact that the provision of earthed lines, as conventional in an ordinary system, is not particularly necessitated, and still more the invention is advantageously versatile in use since the short-circuit member may instantly be removed so as to reform the inventive connector as an ordinary one.

Still further, it is assured according to the invention that when the two connector housings are necessarily kept in separation from each other, the paired terminals in the housing on the "element or load side" are short-circuited by the conductible member, thereby avoiding the generation of potential differences between the terminals while restraining electric currents, if any, which have been induced by external magnetic fields or electric fields occurring outside of the system, from flowing through the circuit elements in the system. Besides, the invention is particularly effective in the dispensation with earthing in the system or in the prevention of malfunctions of the circuit elements with simplified and improved construction.

What is claimed is:

1. A releasable connector for preventing malfunctions in electric circuits, comprising a male connector housing and a female connector housing adapted to fit in each other in face-to-face relation, characterized in that one of said male and female connector housings is provided interiorly, and adjacent to a guide aperture opened at the interface thereof, with a terminal receiving cavity and a short-circuit member receiving cavity with a communicating space formed therebetween, whereby said terminal receiving cavity is provided with a plurality of terminals disposed therein, at least one of said terminals being provided with a projection formed from an electrically conductive material which extends outwardly from said terminal into said short-circuit member receiving cavity, said short-circuit member receiving cavity having disposed therein a resilient short-circuit member formed of electrically conductive material in such a manner that said member extends through the communicating space so as to be brought into resilient contact with the respective projections of said terminals to protect the electrical circuits from malfunctions due to external magnetic and electric fields when the housings are apart, the other of said connecting housings being provided with an insulator member recessively mounted within an interior cavity of the housing, said insulator member being adapted, when the two connector housings are fitted in each other, to be thrusted in between the short-circuit member and the terminals with which the short-circuit member has been in resilient contact, said short-circuit member and the respective projections of said terminal elements being configured so as to orient and guide said insulating member therebetween.

2. A releasable connector according to claim 1, further characterized in that said one connector housing is arranged to be connected to circuit elements incorporated in a system to which said releasable connector is applied, while said other connector housing is arranged to be connected to a power source in said system.

3. A releasable connector according to claim 1, further characterized in that said resilient short-circuit member is fabricated from a thin metal by punching and bending to a generally ellipsoidal configuration having two parallel legs with reversibly bent end portions so that when the two connector housings are released from each other, said end portions of the legs are resiliently urged against the upper surfaces of the terminals.

4. A releasable connector according to claim 1, further characterized in that said terminals in said one connector housing are fabricated from a thin metal plate by bending to a generally rectangular cross-sectional configuration.

5. A releasable connector according to claim 4, further characterized in that said terminals of a generally rectangular cross-sectional configuration are provided with respective projections at the side surfaces facing toward the short-circuit member, said projections being configured to make contact with the short-circuit member when the two connector housings are released from each other.

6. A releasable connector according to claim 1, further characterized in that said guide aperture opened at the interface of the one connector housing is dimensioned to receive the insulator member.

* * * * *